US005687891A

United States Patent [19]

Beletsky

[11] Patent Number: 5,687,891

[45] Date of Patent: Nov. 18, 1997

[54] UNIVERSAL SEMI AUTOMATIC HANDGUN HOLSTER

[75] Inventor: Robert J. Beletsky, Temecula, Calif.

[73] Assignee: Bianchi International, Temecula, Calif.

[21] Appl. No.: 521,142

[22] Filed: Aug. 29, 1995

[51] Int. Cl.[6] ..... F41C 33/02

[52] U.S. Cl. ..... 224/243; 224/624; 224/587; 224/911

[58] Field of Search ..... 224/911, 912, 224/192, 193, 587, 623, 624, 243

[56] References Cited

U.S. PATENT DOCUMENTS

| | | | |
|---|---|---|---|
| 1,903,084 | 3/1933 | Arth | 224/193 |
| 3,707,250 | 12/1972 | Esposito | 224/911 |
| 4,235,356 | 11/1980 | Atchisson | 224/911 |
| 4,286,741 | 9/1981 | Rogers | 224/911 |
| 4,298,150 | 11/1981 | Seldeen | 224/911 |
| 4,346,827 | 8/1982 | Bianchi et al. | 224/206 |
| 4,694,980 | 9/1987 | Rogers | 224/243 |
| 4,721,238 | 1/1988 | Shoemaker | 224/911 |
| 5,018,654 | 5/1991 | Rogers et al. | 224/244 |
| 5,129,562 | 7/1992 | Bianchi | 224/244 |
| 5,150,825 | 9/1992 | Nichols | 224/911 |
| 5,251,799 | 10/1993 | Theodore | 224/911 |
| 5,480,077 | 1/1996 | Eng | 224/911 |

*Primary Examiner*—Linda J. Sholl

[57] ABSTRACT

A universal holster is designed to accommodate a number of different brands, sizes, and lengths of semi automatic handguns and includes a body formed of a layer or double layer of suitable material such as leather formed to define a pocket. Extensions along edges of the body form straps of unequal length with a snap fastener forming a channel the trigger guard of a handgun. One portion of the snap fastener is spaced a short distance from the end of the shorter strap forming a projection which may be contacted by the forefinger of the wearer to open the snap fastener to draw the handgun from the holster. Two additional extensions or bosses are positioned around a spacer near the front of the body. A pair of extensions at the opposite end of the body to define a portion of a pocket around the handgun hammer end of the handgun and to secure a pair of short straps carrying fastening devices for attachment to a shoulder strap. An additional strap is attached to the screw and is formed as a loop to be secured to a wearer's belt. A second embodiment employs a separate elongated reversible strap which passes through loops in the body. A third embodiment utilizes a pair of straps attached to the exterior of the holster body.

28 Claims, 6 Drawing Sheets

FIG. 1
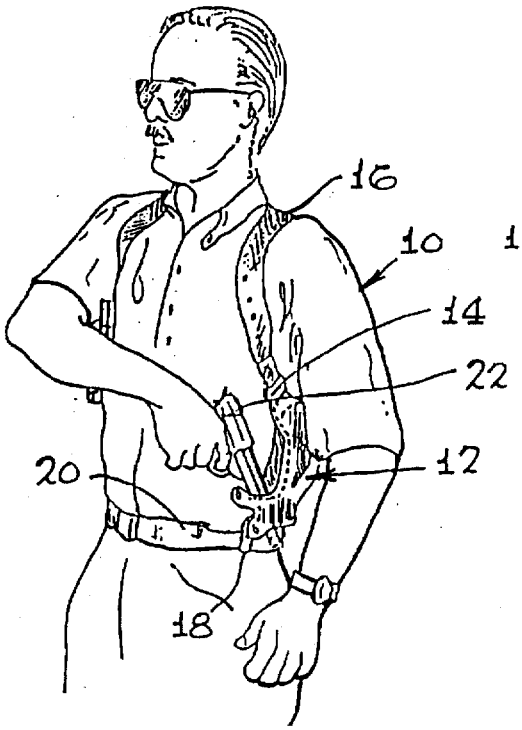
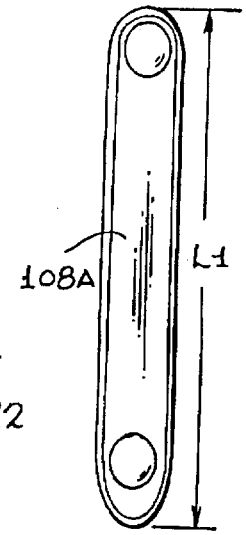
FIG. 14A
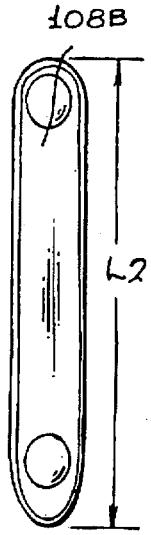
FIG. 14B
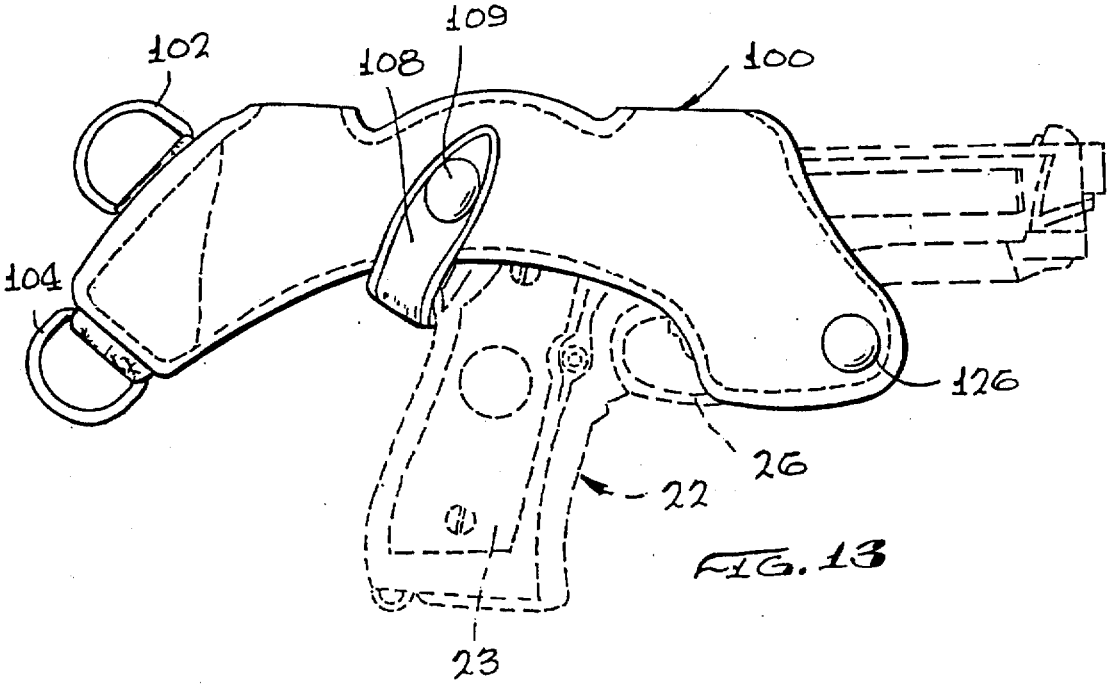
FIG. 13

FIG. 2
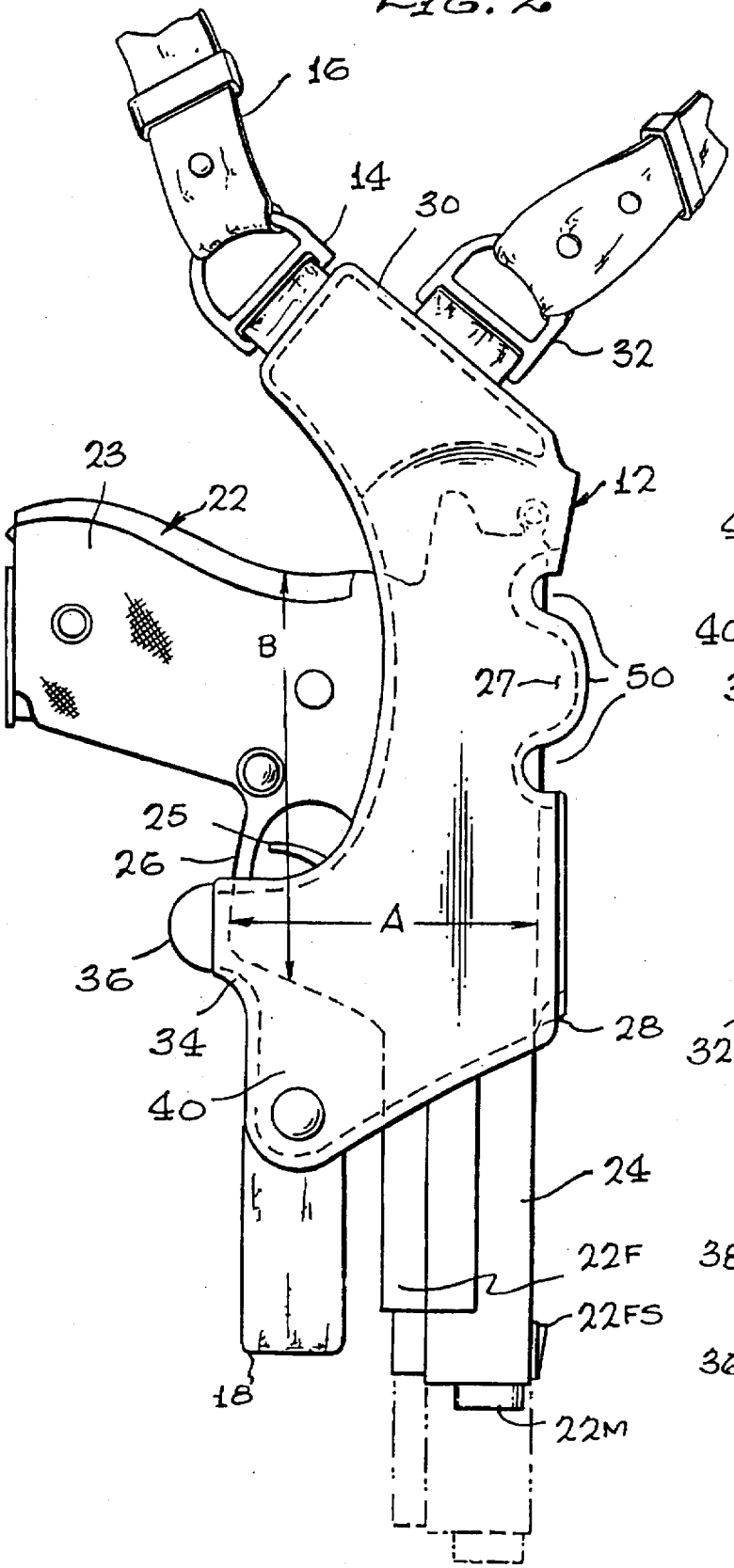
FIG. 3
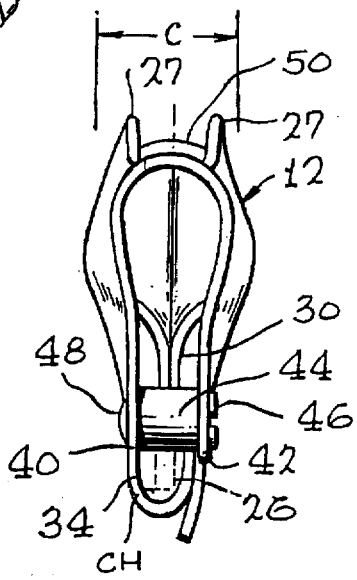
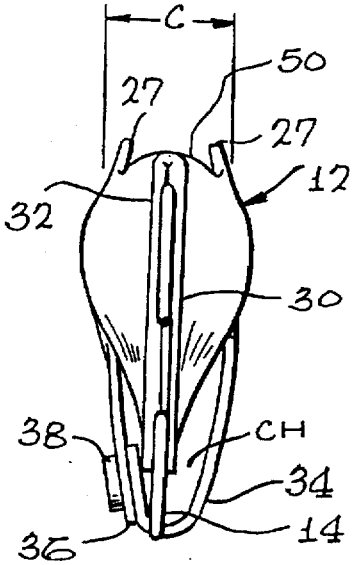
FIG. 4

FIG. 5
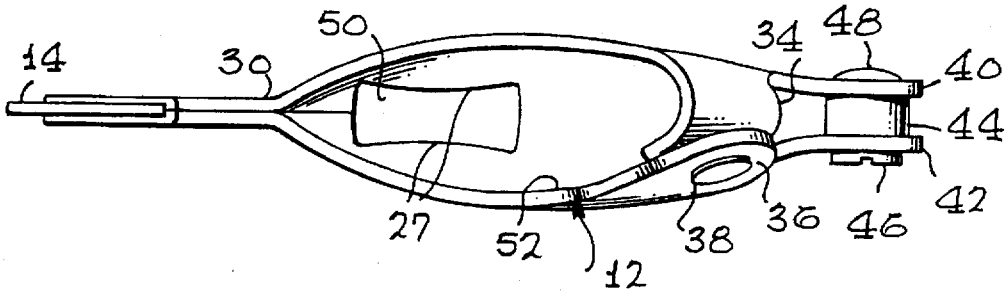
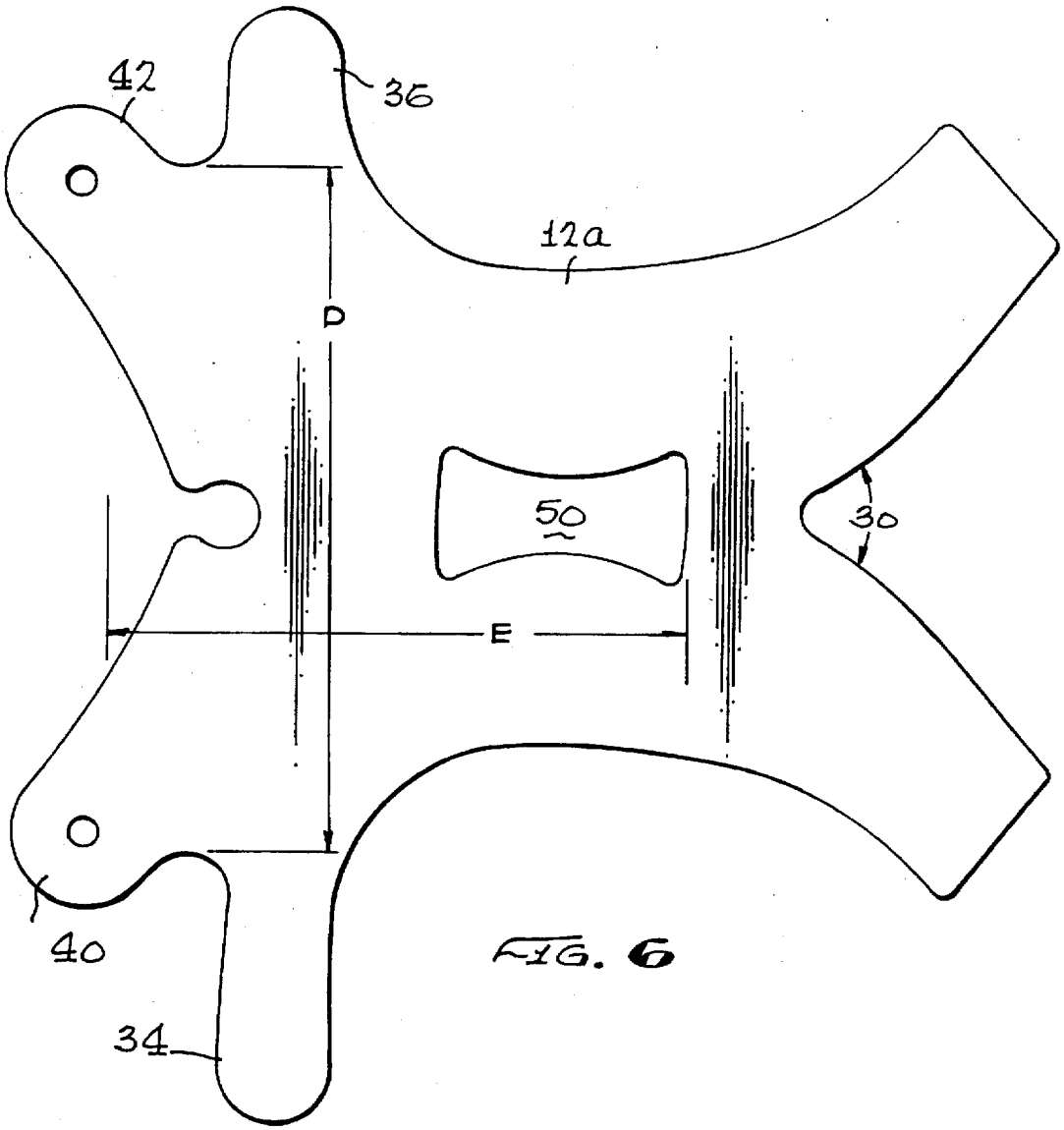
FIG. 6

FIG. 10
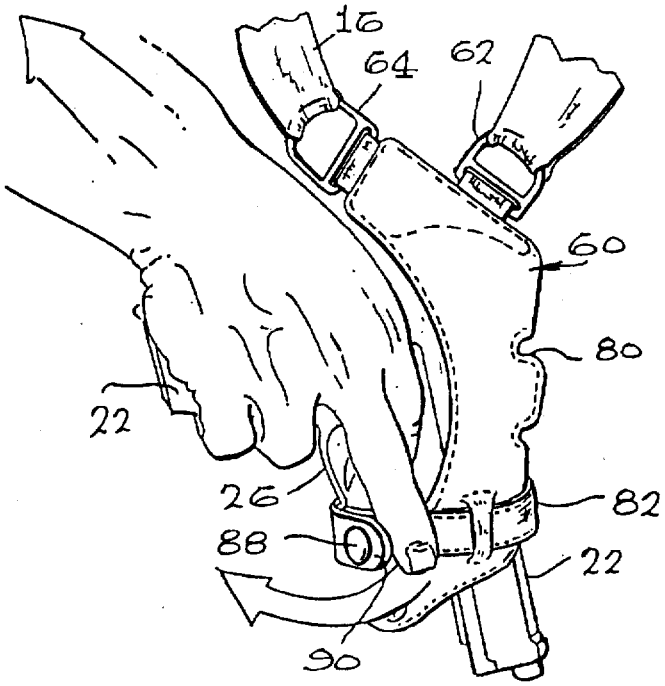
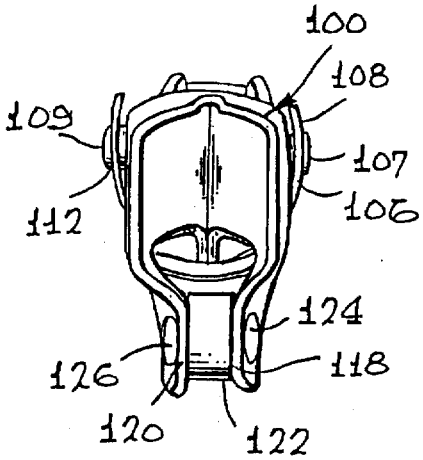
FIG. 12
FIG. 11
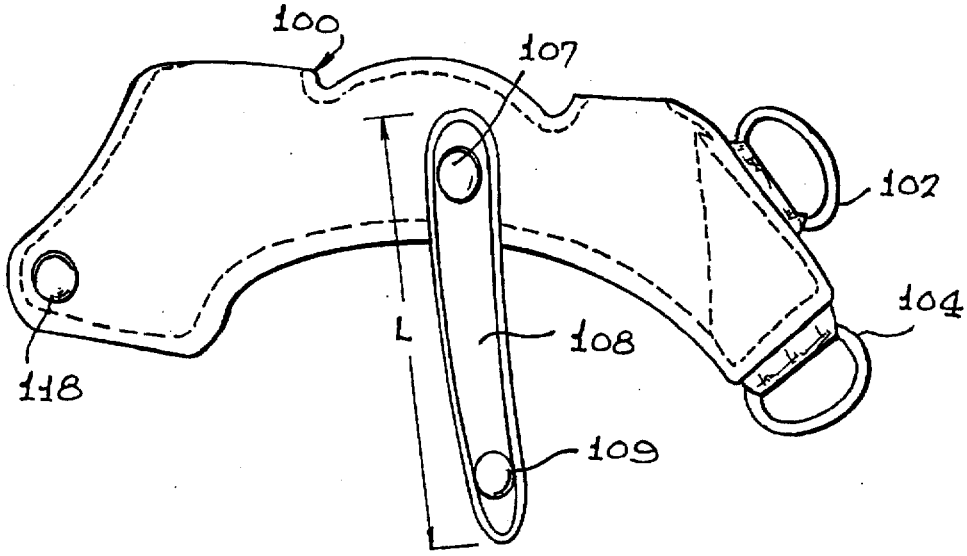

FIG. 15
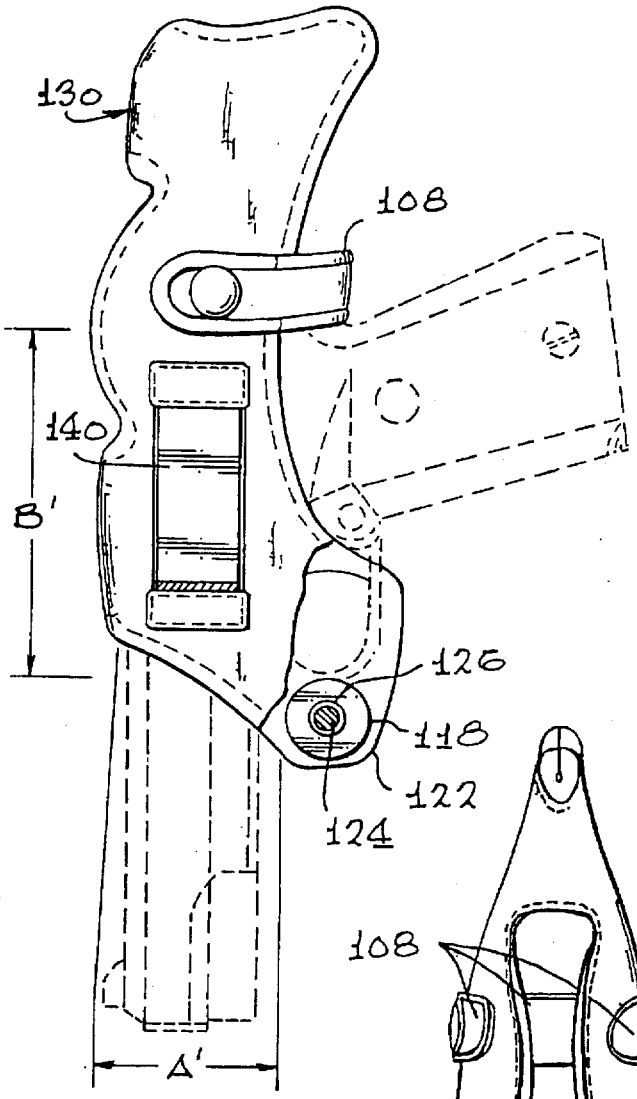
FIG. 16
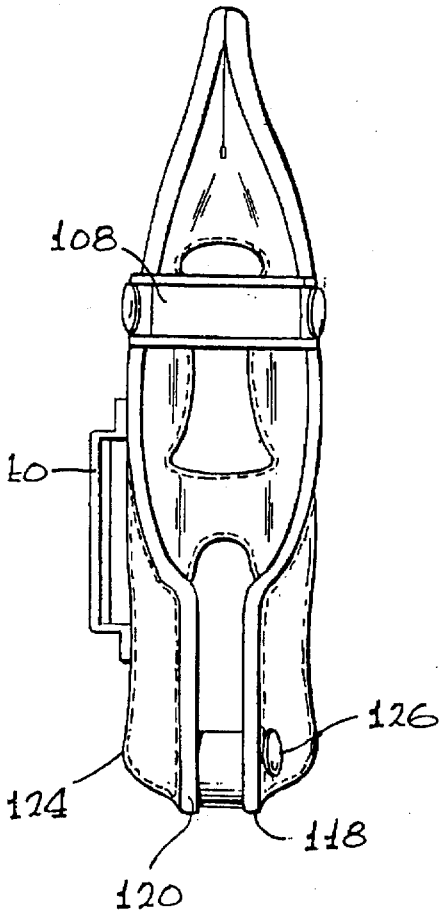
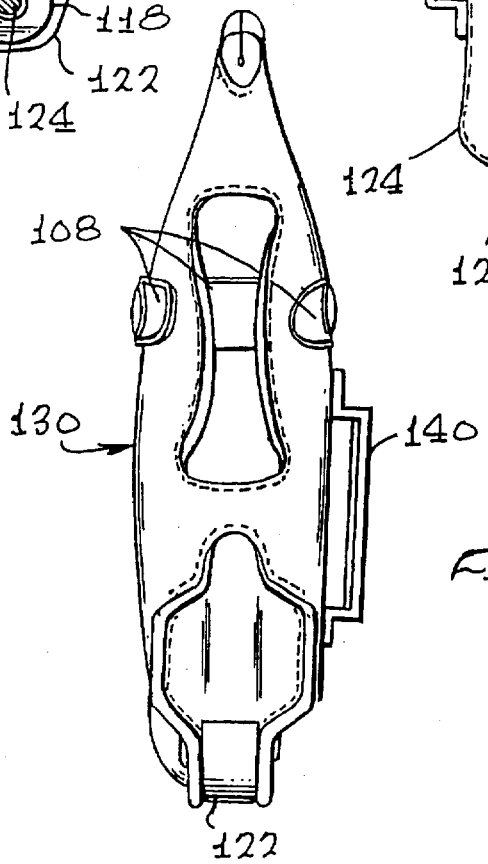
FIG. 17

UNIVERSAL SEMI AUTOMATIC HANDGUN HOLSTER

BACKGROUND OF THE INVENTION

This invention relates to holsters for handguns and more particularly for holsters for accommodating large semi automatic pistols of several brands and configurations.

Applicant has become aware that over time, many law enforcement agencies have acquired semi automatic handguns of varying brands and configurations. Because of the different dimensions of these handguns, it has been necessary to provide several different shoulder holsters having dimensions custom fired to individual brands and models of semi automatic handguns. This is obviously both expensive and inconvenient both for dealers and for agencies which may have several or many such firearms. The differences in dimensions of different holsters are not always readily apparent and a risk exists of holstering the wrong firearm with any number of undesired results. Thus there is a need for a holster that will accommodate a number of different brands and configurations, including lengths, of large semi automatic handguns.

Concealment holsters, particularly shoulder holsters, must carry a handgun under a jacket or a coat without noticeable bulge or movement during normal activities of the officer wearer. At the same time, they must allow the officer to draw the handgun in one smooth rapid movement. These requirements are accentuated in the case of large frame semi automatic weapons. The same requirements exist for concealment belt holsters.

BRIEF DESCRIPTION OF THE INVENTION

After careful study of the dimensions and configurations of the large semi automatic handguns generally in use, applicant has determined that certain dimensions are predictable and uniform, namely:

A) the height between the bottom of the trigger guard and the top of the handgun barrel or slide; and B) the distance from the front of the trigger guard to the grip portion here it bridged by the shooter's hand between the thumb and first finger.

The width of most semi automatic handguns which I have labelled dimension "C" for convenience, is relatively uniform, in the order of 1.0 inch. These measurements provide a relatively uniform total internal distance D and tend to fall within limited ranges even though most other dimensions vary greatly from handgun to handgun. With the two dimensions, A & B established, it became possible to design a holster, particularly a shoulder holster which will accommodate nearly of all large-size semi automatic handguns in use irrespective of variations such as barrel length, frame, slide or grip size.

By keeping the two dimensions A) and B) above, constant, the holster designer is still free to design a holster with a high degree of freedom in all other shapes and dimensions.

To form a holster according to the invention, applicant creates a pattern with the constant dimensions present. Using the pattern applicant then cuts out a blank from a piece of suitable material such as leather and folds the blank over to create a handgun holding pocket. The blank, made according to the pattern, includes specific pairs of projections including a first pair constituting a support for a spacer which is secured between these projections by a screw or other suitable fastener, the spacer cooperating with the fold area to define an opening for the handgun slide and barrel, a second pair of projections which secure the hammer end of the handgun and which also locate and secure a pair or strap fasteners such as D rings for attaching shoulder straps when the holster is to be worn as a shoulder holster and then the second pair of projections are stitched together.

In one embodiment, a third pair of projections constituting straps which receive snap fasteners to provide a channel for supporting a trigger guard. An additional strap is present as an attachment to a wearer's belt.

Also formed in the blank in each embodiment is an opening at the fold which accommodates an exposed pistol hammer, if present.

In a second embodiment, a pair of loops are cut in the blank which accommodate a separate strap which is reversible to make the holster readily adaptable for left or right-handed wearers.

A third embodiment which is likewise ambidextrous utilizes a holster body essentially identical to that of the second embodiment but without the cut-in loops and including a reversible strap having snap fastener members at each end which is fastened to one side of the body, wrapped behind the grip and under the rear of the slide and snapped to another fastener on the opposite side of the body providing a very secure holster.

Upon the discovery of the commonality of dimensions A and B in large flame semi automatic handguns, I have been able to design a belt holster employing these common dimensions resulting in a fourth embodiment.

BRIEF DESCRIPTION OF THE DRAWING

This invention may be more clearly understood with the following detailed description and by reference to the drawings in which:

FIG. 1 is a perspective view of a plain clothed officer in the process of drawing a handgun from the shoulder holster of the invention;

FIG. 2 is a side elevational view of the shoulder holster of FIG. 1 with a semi automatic handgun in place and showing various barrel lengths and dimensions A and B;

FIG. 3 is a lower end view, when worn, of the holster of FIG. 2 with the belt strap removed showing dimension C;

FIG. 4 is an upper end view, when worn, of the holster of FIG. 3 showing dimension C;

FIG. 5 is a front view, when worn, of the holster of FIG. 2 without a belt strap;

FIG. 6 is a plan view of a laid-out, unstitched holster body blank of FIGS. 1–5 showing dimension D;

FIG. 10 is a fragmentary perspective view of a hand and holster of FIG. 7 in the process of removing a semi automatic handgun from the holster;

FIG. 11 is a side elevational view of an additional shoulder worn embodiment of a holster according to this invention showing strap length L.

FIG. 12 is a lower end view, when worn, of the holster of FIG. 11;

FIG. 13 is a side elevational view of the opposite side of the holster of FIG. 11 and showing a semi automatic handgun, in phantom, in place, in the holster;

FIGS. 14 A and B are plan views of two alternate straps which may be used with the holster of FIGS. 11–13 to adapt to different sized semi automatic handguns illustrating strap lengths L1 and L2;

FIG. 15 is an inside elevational view of a belt cross draw holster in accordance with the principles of this invention partly broken away for clarity showing dimensions A' and B';

FIG. 16 is a front elevational, grip side view, of the holster of FIG. 15; and

FIG. 17 is a rear elevational, sight side view, of the holster of FIGS. 15 and 16.

DETAILED DESCRIPTION OF THE PREFERRED EMBODIMENTS

Figure 7:
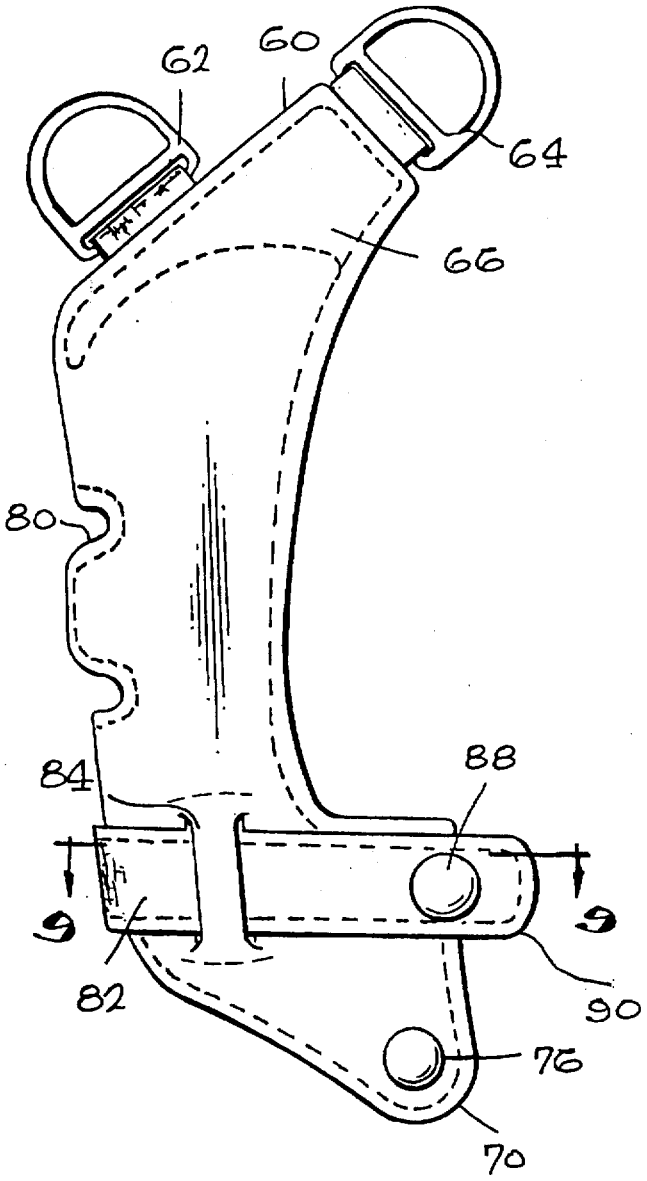
FIG. 7 is a side view of an ambidextrous embodiment of the holster according to the invention.

Referring now to FIGS. 1–4 wherein an officer (wearer) 10 is shown in FIG. 1 wearing a shoulder holster, generally designated 12 which includes a short front strap and D-buckle 14 to which a shoulder strap 16 is attached. The rear end of strap 16 is secured to D ring 32 of FIG. 2. Also, attached to the holster 12 is an additional strap 18 for attachment to the belt 20 of the wearer 10. It will be seen that the wearer 10 is in the act of drawing a semi automatic handgun 22 in a usual manner after releasing an integral strap 36 of the holster 12 as best seen in FIG. 2 and drawing the frame and barrel out through a large front opening.

FIG. 2, a side elevational view of the holster 12, shows a typical large frame semi automatic handgun 22, namely a Beretta, model 92, properly holstered in the holster 12 of FIGS. 1 and 2. The handgun 22 is shown secured in the holster 12 and includes a grip 23, a slide and a barrel assembly 24, a trigger 25, and a trigger guard 26. Note that the grip 23 is fully exposed as is the muzzle 22M and front sight 22 FS. The trigger 25 is protected by the body and strap extensions 34 and 36 described below of the holster 12 as well as its trigger guard 26 but rapidly accessible for the trigger finger as the handgun 22 begins to exit the holster 12. The rear sight, unshown in the drawing is protected within a rear opening by a pair of integral wings 27 which enclose an opening 50.

Fundamental to this invention and best seen in FIG. 2 is the fact that nearly all large frame semi automatic handguns have two dimensions A and B which are nearly identical despite great differences in the length of barrel, size of grip, and size and shape of the slide and barrel. Some handguns are hammerless and some have large hammers. For purposes of identification, the following is a list of large frame semi automatic handguns commonly available today:

| MANUFACTURER | MODELS |
|---|---|
| COLT | GOV. 45, OFFICERS ACP, COMBAT COMMANDER |
| BERETTA | 92, 94, 96 CENTURION |
| S&W | 100–6900 SERIES |
| SIGARMS | 220, 225, 226, 228, 229 |
| GLOCK | 17, 19, 20, 21, 23 |

Heretofore, the industry has considered it essentially to produce markedly different holsters for these different handguns.

I have termed the common dimensions A and B of all of these handguns which are nearly perpendicular as identified by the double-ended arrows in FIG. 2. This discovery and use of the fact that only two dimensions A and B virtually define the requirements for handgun positioning and retention of most semi automatic handguns. These two dimensions, A and B control, since I have found that despite some slight differences in the width C, shown in FIGS. 3 and 4 of the frame and slide of large frame semi automatic handguns, the circumferential distance around the handguns which includes dimensions A and B is extremely uniform. Therefore, I have designed a basically new holster which maintains corresponding dimensions A and B constant and thereby correctly fit numerous handguns although the overall appearances of the handguns makes them look quite different. The measurements which basically define the holster are approximately 2A and C and 2B and C.

Dimension A, as shown in FIG. 2, is the internal distance between the bottom of the trigger guard 26 and the top of the slide 24 of handgun 22. I have found that this distance in A ranges 4.15 in.±0.35 in. regardless of the manufacturer or model for most large frame semi automatic handguns.

Dimension B is the internal holster distance from front of the trigger guard to the rear of the top rear region of the grip. This distance is 2.86 in.±0.25 in., regardless of the manufacturer or model for most large frame semi automatics.

Dimension C is the width of the handgun slide or frame illustrated in FIGS. 3 and 4.

A' and B' are distances A & B plus normal holster internal tolerance of ¼ inch or less.

Now referring additionally to FIG. 6, the circumferential distance D around the slide, the frame and trigger guard for the various handguns which I have termed D includes dimension A and dimension C. This circumferential distance D, equals approximately 2A plus C. The trigger guard adds little to the length of D.

Dimension E is the approximate distance around the grip and the front of the trigger guard 2B'+C since standard grips have widths approximating the slide or frame width.

The following is a listing of some examples of large frame semi automatic handguns showing the similarities of their pertinent dimensions, ranging from the smallest to the largest of the generally available large frame semi automatic handguns:

| MFGR | MODEL | A | B | C | D | E |
|---|---|---|---|---|---|---|
| | | | | | 2A' + C | 2B' + C |
| BERETTA | 92 | 3.0" | 4.09" | 1.11" | 7.11" | 9.29" |
| COLT | GOVT. 45 | 2.69" | 3.85" | 0.91" | 6.29" | 8.61" |
| GLOCK | 20 | 2.71" | 4.27" | 1.125" | 6.54" | 9.66" |
| S&W | 1006 | 2.97" | 4.25" | 0.98" | 6.92" | 9.48" |
| | 4506 | 2.97" | 4.25" | 0.98" | 6.92" | 9.48" |
| SIGARMS | 226 | 2.95" | 4.27" | 1.10" | 7.00" | 9.64" |

All of the above handguns come in a variety of barrel lengths ranging from 3" to 5" inches and different grips may be used according to the owner's preference. All barrel lengths and grip sizes may be carried in the holsters of this invention in which the above nominal dimensions A' and B' are used. Strap adjustment or by change of size of spacer need only provide a tolerance for A' of + or −0.125 inch and for B' of + or −0.10 inch to fit any of the above range of handguns. The utilization of these similarities and near identities is possible since the holsters of this invention provide unrestrained and unenclosed muzzles and grips for the handguns. Therefore, the variably dimensioned parts of the several handguns do not constitute any of the restrained portions.

This near identity of handguns dimensions A and B allows holsters having dimensions A' and B' as specified above to correctly and effectively carry any of the above models and other makes of handguns regardless of their other dimensions.

FIG. 3 shows the lower end view of the holster 12 of FIG. 2 with the handgun 22 removed. In this view it will be seen that a portion of the holster 12 consists of a pair of elongated extensions 34 and 36 which cooperate to form a channel CH forming a support for the trigger guard 26 (shown dashed) of handgun 22. The dimension C represents the widest portion of the handgun frame or slide.

Holster 12, as shown in FIG. 3, also includes an additional pair of projections or bosses 40, 42 which are separated by means of a spacer 44. A screw 46 passes through extensions 40 and 42 and spacer 44 and cooperates with an internally threaded female receptacle 48 to secure members 40, 42 and 44 together. The frame 22F of the handgun 22 moves outward clearing the trigger as in FIG. 1 and rocks over the spacer 44 as the handgun 22 is removed for a smooth movement in either direction. The spacer 44 is preferably made of soft rubber.

FIG. 4 is the upper end view of the holster of FIG. 2 and shows a pair of sewn together wings forming the projection 30 to which the strap/D-buckle assemblies 14 and 32 are attached. Also shown in this view are the projections 34 and 36 which become the handgun restraining strap and thumb break, respectively of the holster which engage each other by means of the snap fastener 38.

As shown in FIG. 4, which is an upper end view of the holster 12, members 34 and 36 are held together by means of a snap fastener 38 resulting in creating the channel CH in which the trigger 26 and trigger guard 26 are located and secured. The members 34 and 36 constitute an integral handgun restraining strap.

The opening 50, shown in FIGS. 2–4, formed in the fold portion of holster body 12 provides space for receiving the rear sight of the handgun 22.

FIG. 5 is a view of the holster 12 as seen from the handgun grip side, (front when worn as a shoulder holster) including extensions 40 and 42, the spacer 44, screw 46 and the receptacle 48 which secure extensions 40 and 42. Also shown in FIG. 5 are the projections 34, 36 which constitute the strap 34 and thumb break 36 held together by snap fastener 38. Through the space between projections 34, 36 and the rear projection 30 is the large opening 52 through which the grip 23 of handgun 22 protrudes and through which the handgun 22 is withdrawn and replaced when the snap fastener 38 is released. The rear sight guard opening 50 and protective wings 27 are also clearly shown in FIG. 5.

Now referring to FIG. 6, as indicated above, the holster 12 is formed by folding over a blank of suitable material such as leather, tri-laminate fabric covered foam or other suitable leather-like holster materials. Die cutting this blank leaves a number of exposed edges which are stitched or bound with binding. In its preferred leather form, the holster 12 is usually composed of two layers of leather, an outer tough layer such as top grain steer hide and an inner soft layer just as suede. The stitch lines 28 which are shown in FIG. 2 represent stitches securing the two layers together or binding stitch lines. The extension 30 wings are shown adjacent the rear portion of the handgun 22 are later stitched together forming the double layer of extension 30. The subsequent stitch operation captures the short strap and D-ring 14 and an additional short strap and D-ring 32 to which the shoulder strap 16 of FIGS. 1 and 2 is secured. Most stitching is accomplished while the blank is flat, greatly facilitating manufacture.

Opening 50 appears in this view as well as the two separate parts of the rear projection 30. The trigger guard projections 36 and 34 are shown as well as the spacer bosses 40 and 42. It will be noted that the pattern is essentially symmetrical except for the additional length of projection 34 which must reach under and around the trigger guard to make contact with the snap fastener on projection 36.

AMBIDEXTROUS EMBODIMENTS

Given the fact that only the constant dimension of the handguns are used to restrain or hold the handgun in place in the holster, my design is easily convened for both left and right-hand shooters.

A separate ambidextrous embodiment of the holster of FIGS. 1–6 is shown in FIGS. 7–10. FIG. 7 is a side view of holster 60 which is similar to holster 12 but modified somewhat so that it may be used by either right or left-handed persons. Holster 60 includes D buckle/straps 62 and 64 which are essentially identical to those shown in FIG. 2 and which are captured in the rear projection 66 which is sewn together in the same manner as rear projection 30 of FIG. 2. Holster 60 is also formed from a pattern very similar to that shown in FIG. 6 and is also sewn together in two layers by means of a plurality of stitch lines 68.

Figure 8:
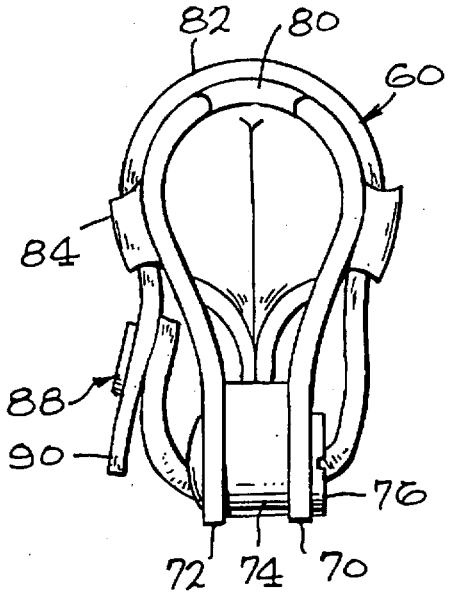
FIG. 8 is a lower end view, when worn, of the holster of FIG. 7.
Figure 9:
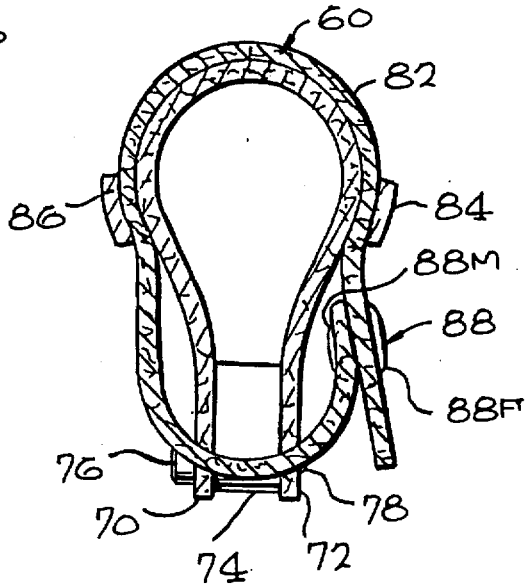
FIG. 9 is a sectional view taken along line 9—9 of FIG. 7.

As shown in FIG. 8, which is a bottom view of holster 60 when worn as a shoulder holster, a pair of forward projections or bosses 70 and 72 are held in position around a spacer member 74 by means of a screw 76 captured by means of an internally threaded female member 78. As in the case of holster 12, holster 60 also has an opening 80 along the fold line for providing clearance for an exposed rear sight of the handgun.

The principal difference between holsters 12 and 60 is that holster 60 is designed for ambidextrous use and instead of the trigger guard projections 34 and 36 of FIGS. 1–6, includes an elongated separate strap 82 which wraps around the holster 60 and is secured in position by passing through slots defining loops 84 and 86 formed in the surface of the body of holster 60 as shown in all of FIGS. 7–10.

As also set forth above, the holster 60 is formed of two layers of material and only the top layer is slotted to provide the loops 84 and 86 thereby ensuring the interior of the holster is sufficiently smooth that there will be no rough edges to interfere with positioning or drawing of the handgun or to mar its finish. As will be seen, the strap 82 is of sufficient length to extend all the way around the holster 60 with the snap fastener 88 having its female portion 88F located generally near the end of this strap 82 and the male portion 88M of FIG. 9 positioned somewhat short of the strap end leaving an extension or end tab 90, commonly termed a thumb break but in this case finger break, suitable for release of the strap by finger action as best illustrated in FIG. 10.

FIG. 10 shows the holster 60 with the handgun 22 in place and the right hand of an individual positioned to draw the handgun 22 from the holster 60. It will be observed that the index finger of the individual holding the handgun 22 is positioned to move in the direction of the arrow which will open the snap fastener 88 which effectively releases the trigger guard 26 of the handgun 22 so that the handgun and the hand can be withdrawn in the position of the large arrow.

In the event the individual wishing to use the holster is left-handed, the strap 82 is removed and reversed and an entirely analogous operation would be performed with the left hand. The holster 60, of course, is then worn on the opposite side from that shown in FIG. 1.

The holster body 60 of FIGS. 7–10 when in blank form, is similar to FIG. 6 except that projections 34 and 36 are missing and the blank 60 is truly symmetrical.

SELECTABLE STRAP EMBODIMENT

FIG. 11 is a side elevation of an additional embodiment of the invention. The body 100A of the holster 100 is very similar to the bodies of the holsters 12 and 60. It does not, however, include the integral straps 34 and 30 of the holster shown in FIGS. 1–6 and it does not include the cut-in loops 84 and 86 and the separate strap 82 of the holster shown in FIGS. 7–10. It does include short strap and D-buckles 102 and 104 which attach to a conventional shoulder harness in the same manner as do straps and D-buckles 14 and 32.

Attached to both sides of body 100 are male halves of snap fasteners 106 and 112, best seen in FIG. 12. A strap 108 has female ends 107 and 109 of snap fasteners at both ends, but with one fastener spaced farther from its end than the other. This enables the wearer to attach the strap 108 either way on the body 100 such that the longer end extends beyond the side of the body 100 on a desired side for use with either the right or left hand to disengage the strap 108 from either snap fastener female member 106 or 112. Strap 108 has a length L.

FIG. 12 is a bottom end view of the holster 100 without the handgun. Strap 108 is attached at fastener members 106 and 112 as it would be if a handgun were present. Similarly to the embodiment of FIG. 8, holster 100 is formed with a pair of forward projections or bosses 118 and 120 which are held in place around a cylindrical spacer member 122 which serves as a forward stop against which the trigger guard 26 of a handgun 22 of FIG. 2, again, rests and a pivot point for insertion or withdrawing the handgun. Spacer member 122 is secured in position by means of a screw 124 captured in an internally threaded female member 126. A stretchable strap member identical to member 18 of FIG. 2 is held in position by members 124 and 126 for securing the lower or front end of the holster 100 to a wearer's belt.

FIG. 13 shows the opposite side of holster 100 from that of FIG. 11 and illustrates a semi automatic handgun 116 in phantom strapped in place in the holster 100 by means of strap 108. The female snap fastener member 109 is shown fastened to fasteners member 112 (not visible in this view) in such manner that strap 108 extends behind the grip and below the hammer regions of semi automatic handgun 22. While the holster bodies of all holsters of the configurations of 11–13 are the same, it has been found that to assure a snug fit, there is a slight size variation in large semi automatic handguns which makes it preferable that straps 108 be of slightly varying lengths. Applicant has shown in FIG. 14 straps 108A and 108B which are each somewhat shorter than strap 108. Applicant has found that where three such straps of varying length are supplied, one such strap of the three will always provide a precise fit chosen by the user.

The following dimensions have been found to provide near universal fit for the holster 100 of FIG. 11:

| Approx. Overall Length of Straps | | Fastener to Fastener |
|---|---|---|
| STRAP | LENGTH | Centerline Distance |
| 108 | 5 in. | 3⅝ in. |
| 108A | 4⅝ in. | 3⅛ in. |
| 108B | 4 5/16 in. | 2 15/16 in. |

Again, in this embodiment, dimensions A' and B' comply with the standard set forth above for near universal fit of large frame semi automatic handguns.

The embodiment of FIGS. 11 through 14 is designed to provide a maximum degree of assurance that the handgun will remain in the holster despite any unusual physical activity of the wearer. With the handgun secured by the strap positioned behind the grip and under the hammer region, there is little likelihood that the handgun will become separated from the holster until wearer strikes or pulls the extended left end of strap 108 (as shown in FIG. 12) away from snap fastener member 112. With strap 108 disengaged from snap fastener 112, the handgun can easily be withdrawn from the holster.

The embodiments of FIGS. 2–5 and FIGS. 7–10, while they hold any large semi automatic handgun reasonably securely in all usual attitudes of the wearer, are designed to facilitate quick removal of the handgun as may at times be required by law enforcement personnel. The FIGS. 11 through 14 embodiment will accommodate essentially all large semi automatic pistols and which holds such handguns securely with the selection of the appropriate strap 108, for most predictable activity of the wearer. The basic configuration of holster body 100 does not change to accommodate any of approximately forty different designs of large frame semi automatic handguns.

BELT WORN EMBODIMENT

While developing this invention with the need for a concealment holster for large frame semi automatic handguns, it appeared to me that belt worn handguns can also use this invention. Therefore, I modified the shoulder holster 100 of FIGS. 11–14 and found that it produced an effective belt holster with the same universality by maintaining dimensions A' and B' at the predetermined values and the grip and barrel unenclosed. FIGS. 15–17 illustrate such a belt holster with identical reference numerals applied to identical parts as are found in FIGS. 11–14.

Holster 130 has a body which is identical to holster 100 except that the upper extension which carries the D rings 102 and 104 is missing. Holster 130, therefore is shorter than holster 100. It has the same spacer 122 and fasteners 124 and 126 on the extensions 118 and 120 and the same straps 108 108A and 108B. Distances A' and B', in this case are the same and are defined by the distance from the spacer 122 to the inside top as distance A' and the distance from the spacer 122 to the strap 108 as distance B'.

The major change which makes holster 130 distinct from holster 100, in addition to the absence of D rings 102 and 104 is the presence of belt loop 140 which is shown in its simplest form is defined by a pair of vertical slots in the classic holster form or it may be an additional sewed on belt loop 40 stitched to the holster 130 at the top or bottom or it may be a length of leather which is stitched at opposite ends to the body 130. Of course, other types of belt loops such as spring or hinged clips as shown in U.S. Pat. Nos. 4,690,315 and D 273,821, assigned to the assignee of this invention, may be used.

The above-described embodiments of the present invention are merely descriptive of its principles and are not to be considered limiting. The scope of the present invention instead shall be determined from the scope of the following claims including their equivalents.

What is claimed is:

1. A holster for handguns having a barrel, a frame having a hammer end, a grip, a trigger and a trigger guard said holster comprising a body of material defining a pocket for holding a handgun including projections for securing said hammer end;

(a) said body also defining a first opening for the insertion of a handgun with the grip extending out of the pocket;

(b) said body defining a second opening for the extension of the barrel of the handgun out of said pocket;

(c) said holster including a first handgun restraining portion extending around the barrel and trigger guard portion of the handgun including fastener means for selectively restraining the handgun in the holster;

(d) said holster including a second handgun restraining portion extending from the front of said trigger guard to said projections;

whereby the grip and barrel of the handgun may extend respectively out of said first and second openings of said body and the handgun is held by said first and second handgun restraining portions.

2. A holster in accordance with claim 1 wherein one of said handgun restraining portions is openable and closable to allow the insertion and removal of the handgun from the holster.

3. A holster in accordance with claim 1 wherein the internal dimension of said holster at said first handgun restraining portion is in the order of 6.8 inches.

4. A holster in accordance with claim 1 wherein the internal dimension at said second handgun restraining portion is in the order of 9.4 inches.

5. A holster in accordance with claim 4 wherein at least one of said handgun restraining portions is integral with said holster body.

6. A holster is accordance with claim 1 wherein said body defines a third opening for allowing a rear sight of a holstered handgun to be unrestrained by said holster body.

7. A holster as claimed in claim 1 wherein an opening is formed along the fold of said body providing clearance for a hammer of said handgun.

8. A holster for handguns comprising a body of material folded to define a pocket for holding a handgun including a first opening for the entrance and exit of said handgun and a second opening for receiving the barrel of said handgun, strap means adjacent said first opening and snap fastener members on said strap means, said strap means when fastened cooperating to define a channel for receiving and supporting the trigger guard of said handgun;

a pair of bosses formed at one end of said body;

a spacer positioned between said bosses and fastener means securing said bosses to said spacer thereby defining said second opening;

means closing said body at its opposite end from said pair of bosses;

straps for securing said holster to a wearer;

wherein said barrel extends outside of said second opening of said handgun; and wherein said strap means and said body encircles the bottom of trigger guard and the top of the handgun to retain the handgun in the holster.

9. A holster as claimed in claim 8 wherein said strap means comprise a first extension of said body constituting a first strap and a second extension of said body constituting a second strap and wherein the cirumferential internal distance within said body from around the handgun trigger guard, the frame, and the top of the handgun is in the order of 6.8 inches.

10. A holster as claimed in claim 8 wherein said strap means comprises a single strap, said body includes loop members for locating and confining said strap, and said single strap may be reversed and reinserted through said loop members to convert said holster for ambidextrous use.

11. A holster as claimed in claim 8 wherein said straps include a pair of short straps with attachment devices captured by said stitch means and a shoulder harness is secured to said attachment devices.

12. A shoulder holster for a semi automatic handgun having a barrel and a handle comprising a beady of material folded to define a pocket for holding a semi automatic handgun, said pocket having adjacent edges, a pair of bosses formed at one end of said body, a spacer and a fastener securing said spacer between said bosses, the space between said spacer and said body defining an opening for said barrel:

strap means and fastener members on said strap means, said strap means when fastened cooperating to define a channel for receiving and supporting a part of said handgun spaced from said spacer;

a pair of mating extensions at the opposite end of said body from said bosses, and stitch means securing said mating extensions together and closing an end of said pocket, said stitch means and said bosses defining an opening for the entrance and exit of said handgun; and straps for securing said holster to a wearer.

13. A holster as claimed in claim 12 wherein said body includes a belt loop member for securing said holster to a belt of said wearer.

14. A holster as claimed 12, wherein said strap means comprise a first extension of said body constituting a first strap and a second extension of said, body constituting a second strap.

15. A holster as claimed in claim 12 wherein said strap means comprises a single strap, said body includes loop members for locating and confining said strap, and said single strap may be reversed and reinserted through said loop members to convert said holster from right to left-hand operation and vise versa.

16. A holster as claimed in claim 12 wherein said straps include a pair of short straps with attachment devices captured by said stitch means and a shoulder harness is secured to said attachment devices.

17. A holster as claimed in claim 12 wherein an opening is formed along the fold of said body providing clearance for a hammer of said handgun.

18. A holster as claimed in claim 12 wherein fastener devices are secured to opposite sides of said body and said strap means comprises a strap having fastener members near each end mating with said fastener devices, said fastener devices being located relative to said body such that said strap may be secured to said body behind the handle of said handgun.

19. A holster as claimed in claim 18 wherein said fastener devices are snap fastener members of one kind and said fastener members are snap fastener members of the opposite kind such that either end of said strap may be secured to either side of said body.

20. A holster as claimed in claim 19 wherein two of said snap fastener members of said opposite kind are attached near opposite ends of said strap with one of said snap fastener members being attached closer to one end than the other thereby providing a greater overhang adjacent one side of said body than the other.

21. A holster as claimed in claim 20 wherein a plurality of said straps are provided to accommodate a plurality of different configurations of said handgun.

22. A holster for semi automatic handguns comprising a body of material folded to define a pocket for said handgun and means for in part closing the edges of said material to define an opening for the exit and entrance of said handgun including a pair of bosses on one end of said body, a spacer positioned between said bosses and a fastener for securing said bosses to said spacer thereby also defining an opening for the barrel of said handgun, a long and a short extension on said edges constituting a first strap and a second longer strap, and mating snap fastener members on said first and second straps, said straps when fastened cooperating to define a channel for receiving and supporting the trigger guard of said handgun, a pair of mating extensions at the opposite end of said body from said bosses, stitches securing said mating extensions together; and strap means attached to said body for supporting said holster on a wearer.

23. A holster as claimed in claim 22 wherein an additional opening is formed along the fold of said body providing clearance for a hammer of said handgun.

24. A holster as claimed in claim 22 wherein said strap means includes a pair of short straps with attachment devices captured between said mating extensions by said stitches.

25. A holster as claimed in claim 22 wherein said strap means includes a stretchable loop for attaching said holster to a belt of a wearer.

26. A holster for a semi automatic handgun having a barrel, a trigger guard and a grip comprising a body of material folded to define a pocket for holding a semi automatic handgun, said pocket having adjacent edges, a pair of bosses formed at one end of said body, a spacer and a fastener securing said spacer between said bosses, the space between said spacer and said body defining an opening for the extension of said barrel out of said pocket:

strap means and fastener members on said strap means, said strap means when fastened together cooperating to define a channel for receiving and supporting one of said trigger guard and a part of said handgun behind said grip;

a pair of mating extensions at the opposite end of said body from said bosses, and stitch means securing said mating extensions together and closing an end of said pocket, said stitch means and said bosses defining an opening for the entrance and exit of said handgun; and means for securing said holster to a wearer.

27. A holster as claimed in claim 26 wherein the internal distance between the bottom of said channel and the inside of the fold of said body is 4.15"±0.35".

28. A holster as claimed in claim 26 wherein said strap means are formed integrally with said body, said strap means when fastened defining a channel for receiving and supporting said trigger guard and the internal distance between the bottom said channel and the inside of said fold is 4.15"±0.35".

* * * * *